United States Patent [19]

Stahlecker

[11] Patent Number: 4,612,763

[45] Date of Patent: Sep. 23, 1986

[54] PRESSURIZED AIR CLEANING ARRANGEMENT FOR AN OPEN-END FRICTION SPINNING MACHINE

[75] Inventor: Fritz Stahlecker, Josef-Neidhart-Strasse 18, 7347 Bad Uberkingen, Fed. Rep. of Germany

[73] Assignees: Hans Stahlecker; Fritz Stahlecker, both of Fed. Rep. of Germany

[21] Appl. No.: 769,716

[22] Filed: Aug. 27, 1985

[30] Foreign Application Priority Data

Sep. 5, 1984 [DE] Fed. Rep. of Germany ..... 3432622

[51] Int. Cl.[4] ..... D01H 7/885; D01H 15/00

[52] U.S. Cl. ..... 57/301; 57/263; 57/401

[58] Field of Search ..... 57/261, 263, 300, 301, 57/304, 400, 401

[56] References Cited

U.S. PATENT DOCUMENTS 4,211,063 7/1980 Bock et al. ..... 57/304 XR
4,380,892 4/1983 Parker et al. ..... 57/301 XR
4,539,804 9/1985 Derichs ..... 57/401 XR
4,541,233 9/1985 Raasch et al. ..... 57/401 XR

FOREIGN PATENT DOCUMENTS 0034427 1/1981 European Pat. Off. .
0052412 8/1981 European Pat. Off. .

*Primary Examiner*—Donald Watkins
*Attorney, Agent, or Firm*—Barnes & Thornburg

[57] ABSTRACT

A device for open-end friction spinning having two adjacently arranged rollers forming a yarn forming wedge-shaped gap therebetween is provided with a suction channel having an effect extending essentially in the direction of the wedge-shaped gap. This suction channel serves for drawing in a yarn end for a piecing operation. It is furthermore provided that this suction channel is selectively connectible to an air pressure source in order to provide a blast of air against the rollers in the region of the wedge-shaped gap. The blast of air serves to clean the rollers and remove debris prior to a piecing operation.

29 Claims, 3 Drawing Figures

PRESSURIZED AIR CLEANING ARRANGEMENT FOR AN OPEN-END FRICTION SPINNING MACHINE

BACKGROUND AND SUMMARY OF THE INVENTION

The invention relates to a device for open-end friction spinning with two adjacently arranged rollers driven in the same direction and defining a yarn forming wedge-shaped gap therebetween. Also included are a fiber inlet and opening device, a suction device for guiding fibers and holding the forming yarn in the wedge-shaped gap, a withdrawal device for withdrawing the formed yarn in the longitudinal direction of the wedge-shaped gap, and a suction channel connectable with a vacuum pressure source and effective essentially in the longitudinal direction of the wedge-shaped gap against the withdrawal direction for drawing in a yarn end to be pieced.

With a device of the above-noted kind as disclosed in European Published Unexamined Patent Application EP-OS No. 34 427 it is known during a piecing operation to lift up the winding spool from the drive, to unwind an already spun yarn end and to shorten the same to a predetermined length. The yarn end is then transported, in bypassing relationship to the continuously running withdrawal device, to a yarn suction channel. By means of the vacuum pressure created by the suction device, the yarn end is sucked into the spinning aggregate. It is provided that a suction slot of the suction device can be closed gradually by degrees against the withdrawal direction of the yarn so that the yarn end is further sucked into the spinning aggregate. In the extension of the wedge-shaped gap at the side opposite the withdrawal device, there is further a suction channel provided which then takes over the sucking in of the yarn end.

It is also disclosed in EP-OS No. 52 412 that the rollers of friction spinning aggregates must be cleaned from time to time, especially after a yarn break. With the known construction, it is therefore provided that the one roller is moveable away from the other roller so that the rollers and the wedge-shaped gap formed by same are accessible for manual cleaning. This work is tedious and the results are dependent upon the care of the servicing personnel. Furthermore there is a very high constructive expenditure required especially for the bearings of the rollers because it is absolutely necessary that the rollers in spite of their relative movement with respect to one another, be held in exact positions with respect to one another when in the operating position.

An object of the present invention is to so construct a device of the above-mentioned kind that a cleaning operation, especially of the region of the wedge-shaped gap, can be carried out effectively and reliably.

Another object of the present invention is to carry out this cleaning operation without incurring unacceptably high construction costs in manufacturing the spinning machine.

These and other objects of the present invention are attained in the provision of means to connect the suction channel to a device to create a cleaning air stream effective in the wedge-shaped gap. According to the invention, these means comprise an already provided construction part used for another function, which auxiliary-wise can carry out a cleaning function. The construction expenditures are themselves maintained relatively small. Furthermore an effective cleaning can be carried out without moving the rollers with respect to one another.

In a further development of the invention, it is provided that the device for creating the cleaning air stream is connected with an air pressure source. With the help of a pressure air stream as a cleaning air stream, one obtains relatively high forces so that an effective cleaning is possible.

In further developments of the invention a traveling servicing device is provided which includes a device adjustably connected to the suction channel for creating the cleaning air stream. Thereby, it is assured that the cleaning of the region of the wedge-shaped gap is not dependent upon the care of the cleaning personnel or servicing personnel. Accordingly, assurance is provided that before the piecing, the same cleaning is carried out so that the same conditions exist for each piecing operation.

In constructively advantageous embodiments it is provided that the servicing device is provided with an adjustable connection line for connecting with the suction channel and with a switching device inside of the servicing device for selectively connecting the connecting line with a pressure air source or a vacuum pressure source. Advantageously, the creation of the suction air stream for the drawing in of the yarn end for a piecing operation uses elements of the servicing device which also take over a function for the cleaning so that the auxiliary expenditures for the cleaning can be maintained low.

In further developments of the invention it is provided that the suction device is provided with means for reducing and/or switching off the vacuum pressure, preferably from the servicing unit. Thereby, on the one hand, it is achieved that the return guidance of the yarn end is simplified because it is then a knot grasped by the rollers. On the other hand it is achieve that during a cleaning, by means of the air pressure stream, the loosened contaminants or particles are not held at the outer surfaces of the rollers.

In further developments of the invention the servicing unit is provided with an adjustable device for receiving the contaminants and which engages with the circumference of the rollers in the region of the wedge-shaped gap. Thereby it achieved that the loosened contaminants are not uncontrollably displaced to random locations within the device, causing disturbances. It is advantageous that the device for receiving the contaminants be connected with a suction device.

In further developments of the invention there are provided means for reversing the rotational direction of at least one of the rollers, which preferably is controlled from the maintenance unit. Thereby an improved cleaning, especially of the wedge-shaped gap, is achieved.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
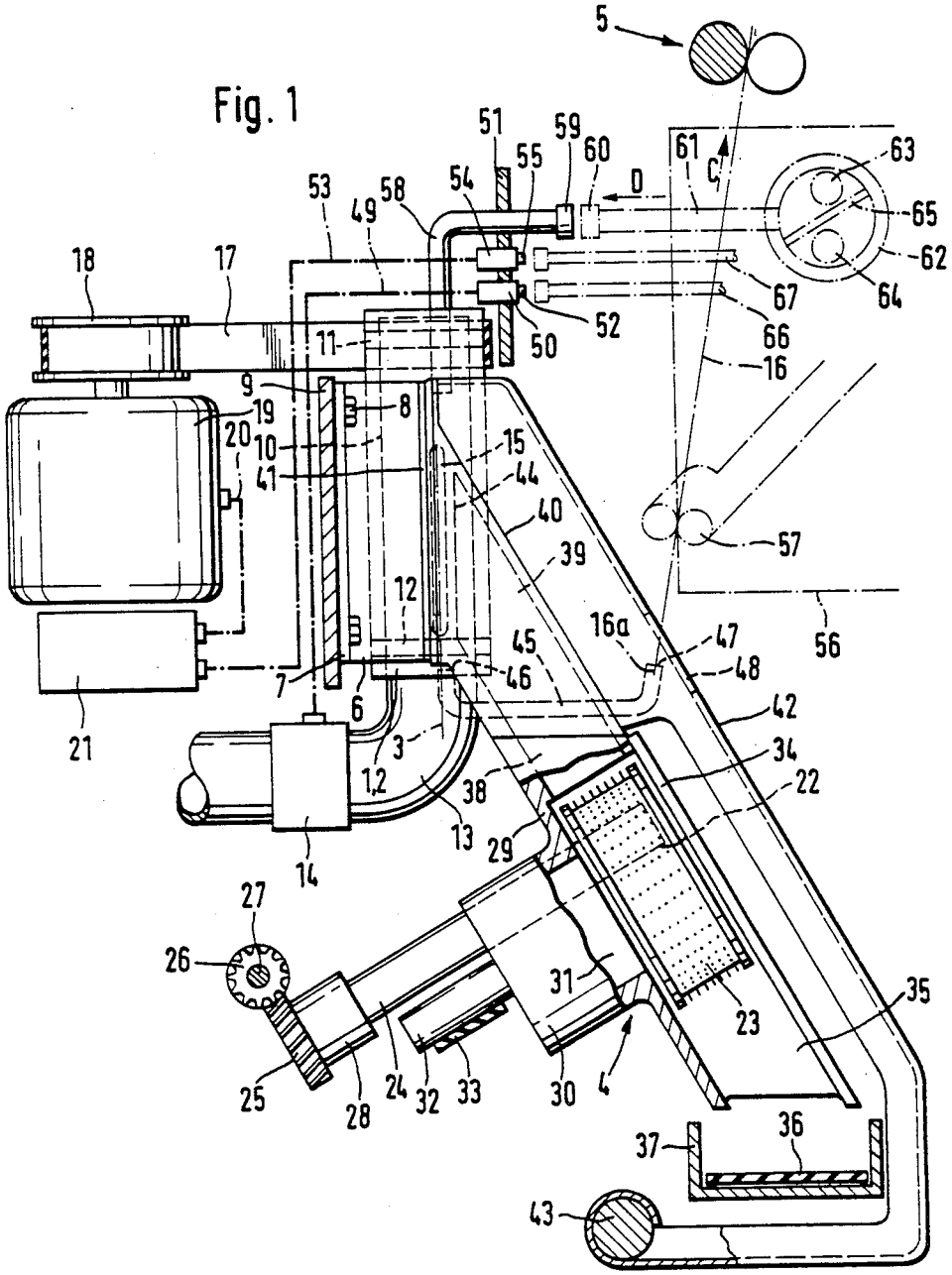
FIG. 1 shows a part sectional side view of a device for open-end friction spinning and partial illustration of a traveling servicing unit engagable with this device, in accordance with a preferred embodiment of the present invention.

The device in FIG. 1 illustrated for open-end friction spinning is a portion of a spinning machine which is formed out of a plurality of similar devices, which preferably are arranged at both side of a machine adjacent one another and in rows. The device includes two friction rollers 1 and 2 having their axes vertically arranged and which run parallel closely adjacent one another and form a yarn forming zone comprising a wedge-shaped gap 3. The rollers 1 and 2 are driven in the same rotational direction as can be seen from the arrows A and B in FIG. 2. The roller 1 which is rotating inwardly toward the yarn forming zone of the wedge-shaped gap is constructed as a so-called suction roller. It possesses a perforated cover inside of which a suction pipe 10 is arranged which includes a suction slit 15 extending in the direction of the wedge-shaped gap 3 and parallel to the gap. The roller 2 is, in the illustrated embodiment, constructed as a so-called solid roller which exhibits a closed cover surface.

The rollers 1 and 2 are carried in a roller housing 6, which is connected in turn to a bearing or bearer member 9 by means of flanges 7 and fastening screws 8. The cover of the roller 1 is rotatably supported by means of roller bearings 11 and 12 at the suction pipe 10, which (in a manner not further illustrated) is affixed to the roller housing 6. The roller 2 is also rotatably supported in the spinning unit in a manner well known in the prior art. The suction pipe 10 extends outward beyond the lower facing surface of the roller 1 and is connected by means of a curved pipe 13 to a vacuum pressure source (not illustrated). An electromagnetic valve 14 is arranged upstream of the suction pipe 10 for controlling the vacuum pressure in the suction pipe or to selectively shut off the vacuum pressure.

The drive of the two rollers 1 and 2 is effected by means of a driving belt 17 which directly engages the surface of rollers 1 and 2 and is extended around a drive disk or pulley 18, which in turn is driven by an electric motor 19. Electric motor 19 of each device is connected to a controller 21 by means of an electrical line 20. The rotational speed of the motor, and therewith the rotational speed of rollers 1 and 2, is adjustable, and also reversible by means of this controller.

The fiber material to be spun is fed to the wedge-shaped gap 3 in the form of individual fibers by a feeding and opening device 4. The feeding and opening device 4 includes a feeding roller 22, which, in a manner not further illustrated, cooperates with a feeding table and inlet drum and feeds the spun fiber band to the feeding and opening device 4. The fiber band grasped by the feeding roller 22 is combed out into individual fibers by the faster running opening roller 23. From the opening roller 23 the individual fibers are guided over a two-part fiber feed channel 38, 39 to the wedge-shaped gap 3. The feeding roller 22 is supported on a pipe 24, which is held by means of a fastening device (not further illustrated) at a bearing. The shaft of the feeding roller 22 extends out of the end of the pipe 24 and is connected by means of a clutch 28 with a toothed gear 25, which in turn engages a toothed gear 26. The gear 26 is driven by means of a shaft 27 extending in the machine longitudinal direction. The electromagnetic clutch or coupling 28 is connected with a yarn detector (not illustrated) which disengages the clutch 28 upon the detection of a yarn break and thereby interrupts the drive of the feeding roller 22 in spite of the continuous turning of the snaft 27.

The opening roller 23 is arranged in an opening roller housing 29. The opening roller housing 29 exhibits a protrusion 30 which receives the bearing housing 31 of the opening roller 23. A shaft 32 of the opening roller 23 extends out of the opening roller housing 29 and is driven by the tangential belt 33 which extends in the longitudinal direction through the machine. A forward side of the opening roller 23 is covered with a cover 34 arranged at the opening roller housing 29.

The opening roller housing 29 is provided with a separation opening 35 for contaminants or particles separated during the opening of the fiber band from the fiber material. Underneath the separation opening 35, a transport belt 36 is arranged which extends in a U-shape cross-sectional trough and carries away the separated contaminants particles or debris.

The first part 38 of the fiber feed channel begins in the opening roller housing 29 somewhat tangentially to the opening roller 23. The second part 39 of the fiber feed channel is disposed in a partial housing 40 which, in the operational position, abuts with a flange 41 at a corresponding flange of the roller housing 6. The two parts 38 and 39 of the fiber feed channel are disposed in a straight line and together extend with a sharp angle of approximately 45° with respect to the wedge-shaped gap 3. The two-part fiber feed channel 38, 39 is disposed thereby essentially in the wedge-shaped gap plane, i.e. in the plane extending tnrough the wedge-shaped gap 3 and perpendicularly to the plane containing the axes of the two rollers 1 and 2. The part 39 of the fiber feed channels opens with its mouth 44 immediately in the region of the wedge-shaped gap 3, at a very small distance from the wedge-shaped gap. The mouth 44 extends slit-shaped in the longitudinal direction of the wedge-shaped gap 3.

The partial housing 40 is fastened at a covering 42 for covering the feed and opening device 4 and the region of the rollers 1 and 2. This cover 42 is pivotably mounted on a shaft 43 extending in the machine longitudinal direction underneath the feeding and opening device 4.

There is further a yarn withdrawal channel 45 arranged at the cover 42 which has an inlet opening 46 disposed under the rollers 1 and 2 approximately as an extension of the wedge-shaped gap 3. The yarn withdrawal channel 45 exhibits two turning portions and possesses an outlet opening 47 in the region of an opening 48 of the cover 42, which opening 47 extends upwardly to a withdrawal device 5 formed as a roller pair. The spun yarn 16 is thereby immediately withdrawn downwardly in the longitudinal direction of the wedge-shaped gap 3, i.e. in essentially the direction against the feeding direction of the feed channel 38, 39 and then upwardly in the direction of the arrow C to the withdrawal device 5 by the withdrawal channel 45. There follows at the withdrawal device 5, a spooling device (not illustrated) by means of which the spun yarn is wound onto a cross spool.

The electromagnetic valve 14 of the suction pipe 10 is connected by means of a line 49 with a switch 50 arranged at the forward side of the spinning unit. The switch fastened at a covering part 51 or the like includes a push button 52 by means of which the activation of the electromagnetic valve 14 is controllable for reducing or completely shutting off the vacuum pressure in the suction pipe 10. A further switch 54 with a push button 55 is arranged at the covering part 51 or the like which is connected to the controller 21 of the electric motor 19 by means of line 53. With this switch 54, the rotational direction of the electric motor can be reversed.

The spinning unit is further provided with a suction channel 58 in the region opposite the yarn withdrawal pipe 45. This suction channel 58 extends up to the region of the wedge-shaped gap 3. Outside of the rollers 1 and 2 the suction channel 58 is curved outwardly to the servicing side and provided with a connecting piece 59 which includes a preferably self-closing connection.

Figure 2:
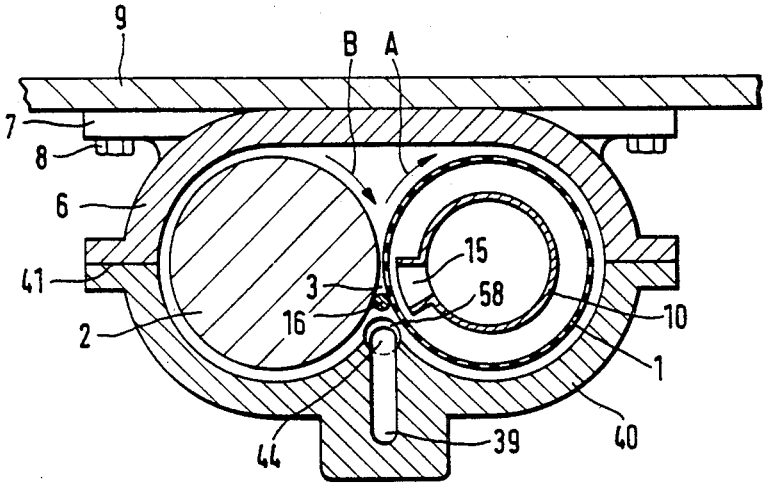
FIG. 2 is a part sectional view through the apparatus of FIG. 1 in the region of the wedge-shaped gap formed by the rollers at the yarn formation position.
Figure 3:
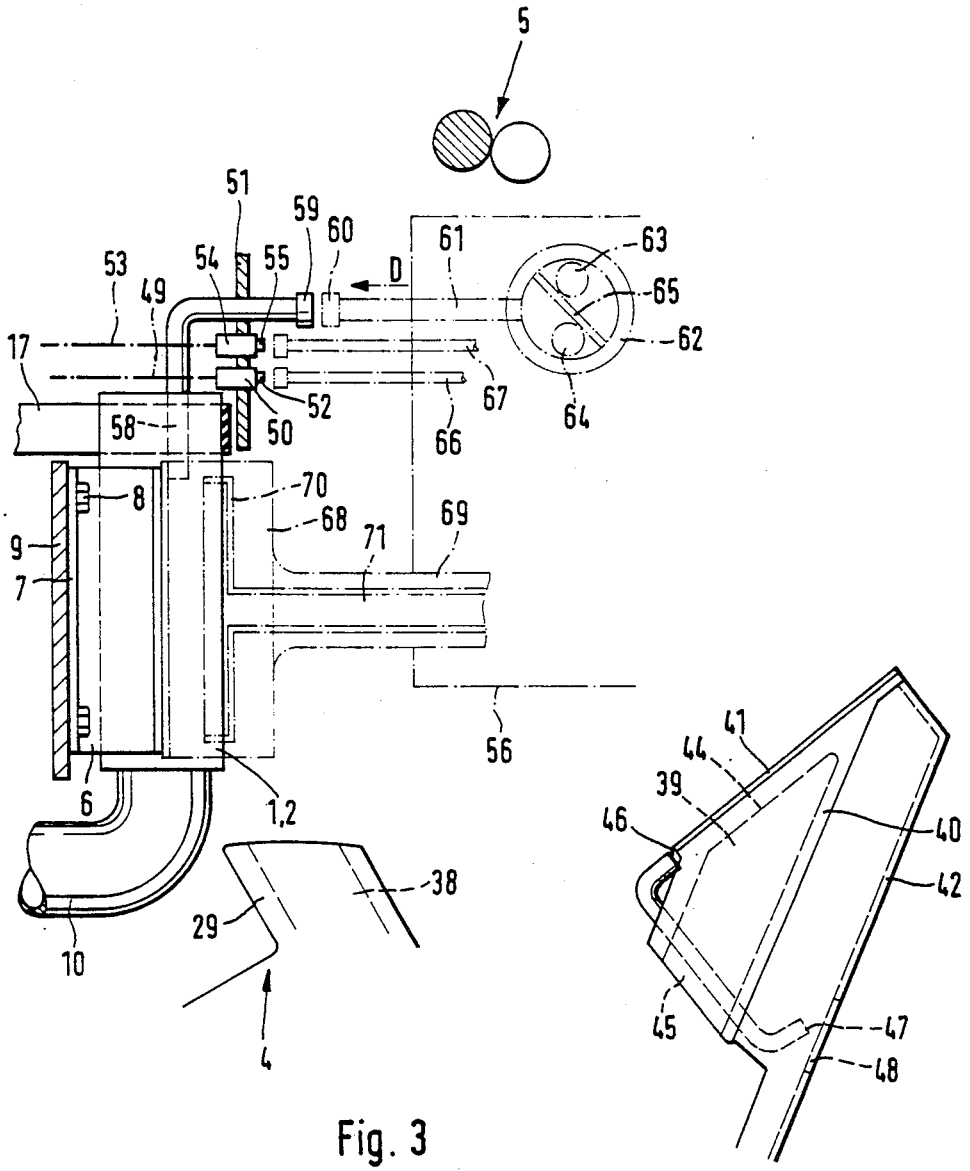
FIG. 3 is a part sectional view of the device according to FIG. 1 in an opened position during the carrying out of a cleaning operation via the servicing unit.

The spinning machine, which includes a plurality of the above-described spinning units connected together, includes at least one servicing or maintenance unit 56 which is only partially schematically illustrated in FIGS. 2 and 3. The maintenance unit 56 includes driving means for driving it along rails at the spinning machine and means for engaging it with the individual units. The maintenance unit 56 is capable of performing a start spinning operation. Through devices (not illustrated) a yarn end 16A is sought at the winding spool and is withdrawn against the normal withdrawal direction. Preferably after a working of the yarn end 16A it is guided by means of auxiliary withdrawal pair 57 to the opening 47 of the yarn withdrawal pipe 45. The suction channel 58 is adjustably moveably connectable by means of a connecting piece 59 to the adjustable connecting piece 60 of outwardly moveable line 61 of the maintenance device 56. Line 61 is connected to a vacuum source by means of line 63. Thereby there is created an air stream through the suction pipe 58 inside of the yarn withdrawal pipe 45 and in the region of the wedge-shaped gap 3, by means of which the yarn end 16A is caused to return into the spinning unit. The auxiliary withdrawal rollers 57 are driven against the normal withdrawal direction so that the yarn end 16A can be returned to the spinning unit. Through a corresponding control of the auxiliary withdrawal rollers 57 the desired predetermined length of yarn is provided.

The maintenance unit 56 is furthermore provided with a pressure member 66 by means of which the push button 52 of the switch 50 of the electromagnetic valve 14 is activated. During the return suction of the yarn end 16A the vacuum pressure in the suction pipe 10 is reduced or completely interrupted by activitation of the switch 50. The maintenance unit 56 further includes a pressure member piece 67 for engaging the push button 55 of the switch 54 so that the control device 21 is controllable by means of the maintenance unit 56. The driving forward movement of the pressure piece 67 and the switch 54 are preferably so constructed that different switch positions are adjustable corresponding to the desired switching function of the controller 21, i.e. a stopping of the electric motor, a running with reduced rotational speed, and if desired, a reversing of the rotational direction.

After the yarn end 16A is return-guided in a determined length, the line 61 is pulled back so that the suction effect of the suction pipe 58 is interrupted. The actual piecing operation is then carried out by means of the servicing or maintenance unit 56. In a predetermined time sequence, the auxiliary withdrawal rollers 57 are switched in the withdrawal direction and the pressure pieces 66 and 67 are withdrawn. Furthermore, in a predetermined time sequence, the fiber band feeding by means of driving of the feed roller 22 is begun and therewith the feeding of the single fibers to the wedge-shaped gap 3.

The above-described piecing operation is preferably preceded by a cleaning process by means of which especially the region of the wedge-shaped gap 3 is cleaned. This is because the contaminants in the region of the wedge-shaped gap 3 can lead to a reduction in the yarn quality or can be the reason for a yarn break. This cleaning process is carried out before the actual piecing by the maintenance unit 56. The maintenance unit 56 is provided with means (not-illustrated) with which the spinning unit can be opened by pivoting away of the cover 42 and the housing part 41 therewith (FIG. 3). Thereby, the circumference of the rollers 1 and 2 in the region of the wedge-shaped gap 3 is conveniently exposed. A collector housing 68 is then adjusted to the circumference of the rollers 1 and 2. This housing 68 has a contour corresponding somewhat to the partial housing 40 and abuts at the flange of the roller housing 6. The housing 68 is arranged at an arm 69 which includes a suction line 71 which ends in the region of a bowl-shaped opening 70 which is designed to be disposed in the region of the wedge-shaped gap 3. The line 61 with the connecting piece 60 is displaced in the direction of arrow D so as to engage connecting piece 59 of the suction pipe 58. By means of switching valve 62, the line 61 is on the one hand connected with the previously described suction line 63 and on the other hand with a pressure line 64. The pressure line 64 is connected to an air pressure source. By rotating the switching valve 62 a disk 65 is so adjusted that for the cleaning of the line 61 and the suction pipe 58, a blast of pressurized air is provided. Thereby there will be a blast of cleaning air out of the suction channel 58 in the region of the wedge-shaped gap 3 by means of which the rollers 1 and 2 are cleaned in the region of the wedge-shaped gap 3. The contaminants particles, or fiber residue located in the wedge-shaped gap are then loosened and sucked off by means of the suction housing 68. Also during the cleaning, the pressure members 66 and 67 will be already adjusted to the switches 50 and 54. Preferably it is thereby provided that the electromagnetic valve 14 is closed by means of the switch 50 so that the vacuum inside of the roller 1 (and if applicable, also the roller 2) is fully suspended. Simultaneously it is provided that the controller 21 is so switched by means of the switch 54 that the rollers 1 and 2 reverse their rotational direction and advantageously run with reduced speed.

In a departure from the above-described embodiment, it is contemplated that the spinning unit need not be opened for cleaning. The housing 68 is then not included. It is then advantageous if an auxiliary suction is provided at the unit by means of which the loosened particular or contaminants can be evacuated from the spinning unit.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for open-end friction spinning having at least one spinning unit including drivable friction surface means defining a yarn formation zone and suction channel means disposed adjacent said yarn formation zone for drawing in a yarn end to be pieced during a piecing operation, comprising:

first air stream means for applying a suction force on said yarn end, second air stream means for creating a cleaning air stream in the region of the yarn formation zone, and control means for selectively connecting said suction channel means with said first and second air stream means.

2. An apparatus according to claim 1, wherein the drivable friction surface means comprises a pair of adjacently arranged friction rollers rotatable in the same direction, and said yarn formation zone comprises a wedge-shaped gap formed between the pair of friction rollers.

3. An apparatus according to claim 1, further comprising fiber band opening means, for separating a fiber band into individual fibers to be fed to the yarn formation zone, suction device means for guiding said individual fibers and holding a forming yarn in the yarn formation zone, and yarn withdrawal means for withdrawing formed yarn from the yarn formation zone.

4. An apparatus according to claim 1, wherein the second air stream means is connectible with a pressurized air source.

5. An apparatus according to claim 1, further comprising a movable maintenance device, said movable maintenance device including said first and second air stream means.

6. An apparatus according to claim 1, further comprising a movable maintenance device, said maintenance device including said control means.

7. An apparatus according to claim 5, wherein said maintenance device includes said control means.

8. An apparatus according to claim 1, wherein said air control means comprises switching means for selectively supplying said suction channel with one of pressurized air and vacuum.

9. An apparatus according to claim 7, wherein said air control means comprises switching means for selectively supplying said suction channel means with one of pressurized air and vacuum.

10. An apparatus according to claim 9, wherein said control means includes adjustable connection line means for connecting said suction channel means with said switching means.

11. An apparatus according to claim 3, wherein said suction device means comprises suction adjusting means for adjusting air flow in the yarn formation zone during a servicing operation.

12. An apparatus according to claim 11, wherein said suction adjusting means are capable of being activitated by activitating means of the maintenance device.

13. An apparatus according to claim 12, wherein said vacuum adjusting means are capable of shutting off the air flow in the yarn formation zone.

14. An apparatus according to claim 1, further comprising a movable maintenance device, said maintenance device including adjustable cleaning device means for removing particles removed by said cleaning air stream.

15. An apparatus according to claim 14, wherein the adjustable cleaning device is engagable with the friction surface means in the region of the yarn formation zone.

16. An apparatus according to claim 15, further comprising vacuum source means, said vacuum source means being connectible with said adjustable cleaning device means.

17. An apparatus according to claim 1, comprising reverse switching means for reversing a drive direction of said friction surface means.

18. An apparatus according to claim 17, further comprising a movable maintenance device, said reverse switching means being controllable from said maintenance device.

19. Apparatus for open-end friction spinning having at least one spinning unit including drivable friction surface means defining a yarn formation zone and suction channel means disposed adjacent said yarn formation zone for drawing in a yarn end to be pieced during a piecing operation, comprising:

movable maintenance unit means for servicing said spinning unit, and valve means connectable with said suction channel means for directing an air flow through said suction channel means, said valve means being carried on said movable maintenance unit means.

20. An apparatus according to claim 19, wherein the drivable friction surface means comprises a pair of adjacently arranged friction rollers rotatable in the same direction, and said yarn formation zone comprises a wedge-shaped gap formed between the pair of friction roller.

21. An apparatus according to claim 19, further comprising fiber band opening means for separating a fiber band into individual fibers to be fed to the yarn formation zone, suction device means for guiding said individual fibers and holding a forming yarn in the yarn formation zone, and yarn withdrawal means for withdrawing formed yarn from the yarn formation zone.

22. An apparatus according to claim 19, further comprising pressurized air source means and vacuum source means connected to said valve means.

23. An apparatus to claim 19, wherein said valve means comprises switching means for selecting supplying said suction channel means with one of pressurized air and vacuum.

24. An apparatus according to claim 23, wherein said valve means includes adjustable connection line means for connecting said suction channel means with said switching means.

25. An apparatus according to claim 19, wherein said maintenance device includes adjustable cleaning device means. for removing particles removed said air flow.

26. An apparatus according to claim 25, wherein the adjustable cleaning device is engagable with the friction surface means in the region of the yarn formation zone.

27. An apparatus according to claim 26, further comprising vacuum source means, said vacuum source means being connectible with said adjustable cleaning device means.

28. An apparatus according to claim 19, comprising reverse switching means for reversing a drive direction of said friction surface means.

29. An apparatus according to claim 28, wherein said reverse switching means is controlled by switching control means on said maintenance device.

* * * * *